US006931818B2

(12) United States Patent
van der Laan

(10) Patent No.: US 6,931,818 B2
(45) Date of Patent: Aug. 23, 2005

(54) METHOD AND APPARATUS FOR PACKING FLOWER BOUQUETS

(75) Inventor: Paulus Maria van der Laan, Ex Ter Aar (NL)

(73) Assignee: Createch (NL)

( * ) Notice: Subject to any disclaimer, the term of this patent is extended or adjusted under 35 U.S.C. 154(b) by 0 days.

(21) Appl. No.: 10/778,682

(22) Filed: Feb. 13, 2004

(65) Prior Publication Data

US 2004/0250511 A1 Dec. 16, 2004

(30) Foreign Application Priority Data

Feb. 14, 2003 (NL) ..... 1022685
Oct. 3, 2003 (EP) ..... 03078081

(51) Int. Cl.[7] ..... B65B 25/02

(52) U.S. Cl. ..... 53/399; 53/499; 53/473; 53/176; 53/582; 53/251; 53/260

(58) Field of Search ..... 53/397, 399, 582, 53/585, 449, 473, 173, 176, 580, 251, 255, 260, 262; 47/72

(56) References Cited

U.S. PATENT DOCUMENTS 4,027,458 A * 6/1977 Goodman ..... 53/251

FOREIGN PATENT DOCUMENTS

| | | | | |
|---|---|---|---|---|
| JP | 11029115 A | * | 2/1999 | ..... B65B/25/02 |
| NL | 9002220 | * | 5/1992 | ..... B65B/25/02 |
| NL | 9002555 | * | 6/1992 | ..... B65B/25/02 |
| NL | 1020379 C6 | * | 10/2003 | ..... B65B/25/02 |
| WO | WO 200194207 A1 | * | 12/2001 | ..... B65B/25/02 |
| WO | WO 03/004359 A1 | * | 1/2003 | ..... B65B/25/02 |

OTHER PUBLICATIONS

International Search Report for NL 1022685 dated Oct. 20, 2003.

* cited by examiner

*Primary Examiner*—Stephen F. Gerrity
(74) *Attorney, Agent, or Firm*—McDermott Will & Emery LLP

(57) ABSTRACT

The invention relates to a work method and apparatus for packing flower bouquets (3), in which large amounts of flower bouquets (3) are transported transversely on a conveyor belt (4) to a lifting conveyor belt (7) to a mounted thereon transversely placed feeding belt (17), which has compartments (20) which constantly contain a flower bouquet (3), which is brought from a horizontal to a vertical position, in which a box-shaped cell space (22) is created and a cross partition turns away and subsequently the flower bouquet (3) falls through a trap door instrument (24) into an already opened cover (25) and is then further processed and brought to a collecting box for shipment.

10 Claims, 3 Drawing Sheets

METHOD AND APPARATUS FOR PACKING FLOWER BOUQUETS

FIELD OF THE INVENTION

The present invention relates to a work method for packing flower bouquets and such, in which on the one hand the flower bouquets are fed by means of a conveyor belt to a drive guiding instrument, on the other hand, to be released above a fed opened cover, after which the flower bouquet with closed cover is further transported and placed into shipping boxes.

BACKGROUND OF THE INVENTION

A similar work method and apparatus is known from the European patent document nr. 0 590 269 A1, submitted Jul. 30, 1993, titled: "Article Packaging System" of the applicant Highland Supply Corporation, 1111 Sixth Street, Highland, Ill. 62249 (USA), inventors CRAIG Frank, 90 Inez, Valley Park, Mo. 63088 (USA); STRAETER, Joseph G., 3817 Praire Road, Highland Ill. 62249 (USA) and WEDER, Donald E., 621 Main Street, Highland Ill. 62249 (USA).

Here, it concerns a modular system for packing articles for shipment, especially potted plants, which are put into a decorative cover and subsequently automatically placed into a protecting cover, after which the packed plants are ready for putting into a shipment box, in which the several components of the system can also be adjusted to the different packing demands and circumstances, such as fragrance, gas tightness and such.

The work method for packing an article, mostly a plant or botanic item, consists of a number of steps such as: applying or feeding the article with an external surface, then applying a decorative cover around the external surface of the article to form an attractively packed article, and then automatically applying a cover around the already decoratively covered article and the apparatus is also claimed for the execution of these specific work methods.

With this invention the concerned potted plant is covered and after that held above an opened cover which is then sealed for, for example, shipment.

The above described work method and apparatus has disadvantages with regard to packing flower bouquets, being that loose flower bouquets must be brought from a horizontal lying position as a bouquet into a vertical position, to, then be slided or dropped into an opened cover without losing the coherence of the bouquet, which with the known apparatus and work method is not possible.

In practice the packing or covering of large amounts of loose flower bouquets is mainly done manually, which is very time-consuming or the flower bouquets are fed by means of a conveyor belt to a slanting chute, after which the flower bouquet falls into an opened cover and after which, with a binding machine, a binding wire is wound around the stems of the flower bouquet. Also this last method is not very fast to efficiently process large amounts of flower bouquets.

BRIEF SUMMARY OF THE INVENTION

The aim of the present invention is to provide such a work method and apparatus that the disadvantages are eliminated and which apparatus works efficiently, can cover very large amounts of flower bouquets in a short time and which apparatus can be put onto the market in a very economically responsible way.

For this purpose a work method with a special apparatus is developed in a very inventive way, that the mentioned flower bouquets are fed lying transversely in the movement direction by a first approximately horizontal set up conveyor belt, called the bouquet line, on which the flower bouquets are laid down with a suitable mutual distance L so that via a lifting conveyor belt, at the end of the mentioned first conveyor belt, then fall onto a second conveyor belt or feeding belt placed at a right angle on the first conveyor belt, in which the mentioned feeding belt rotates at an angle $\alpha$ of the approximately horizontal position into the vertical position, in which on the mentioned feeding belt by means of lateral and cross partitions compartments are formed in which a flower bouquet is dropped continuously, in which when rotation the feeding belt over an angle a the compartments go from a horizontal to a vertical position and is closed by a vertical plate into a box shaped cell space, after which the cross partition turns away and the flower bouquet falls with its stems onto a trap door instrument, which opens subsequently and the flower bouquet drops into an already opened cover, after which the flower bouquet in the cover is wrapped with a band or tape around the stems and the thus packed flower bouquet is further transported by means of conveyor belts to collecting boxes for further shipment of the packed flower bouquets.

The advantage is an efficient work method to pack large amounts of flower bouquets with a relatively compact machine.

Further, the apparatus according to the invention is further developed in such a way, that this device consists of the following parts, such as a first conveyor belt and a lifting conveyor belt a second conveyor belt or feeding belt placed at a right angle, provided with lateral and cross partitions with height to form compartments into which the flower bouquet has been dropped, in which the mentioned feeding belt is transferred from the horizontal position into the vertical position and runs along a vertical plate, so that a box-shaped cell space is created including the flower bouquet, after which the cross partition below the flower bouquet is turnable and the flower bouquet lands on a trap door instrument, which can be opened and the flower bouquet drops into an opened cover, after which further processing takes place and discharging is done via conveyor belts to the packing of the flower bouquets, in which the material of the apparatus can be stainless steel.

The advantage is a compact machine or apparatus to execute the work method in the most efficient way.

BRIEF DESCRIPTION OF THE DRAWINGS

The preferred construction of the invention will be described by way of example, and with reference to the accompanying drawing.

In which.

DETAILED DESCRIPTION OF THE PREFERRED EMBODIMENTS

Figure 1:
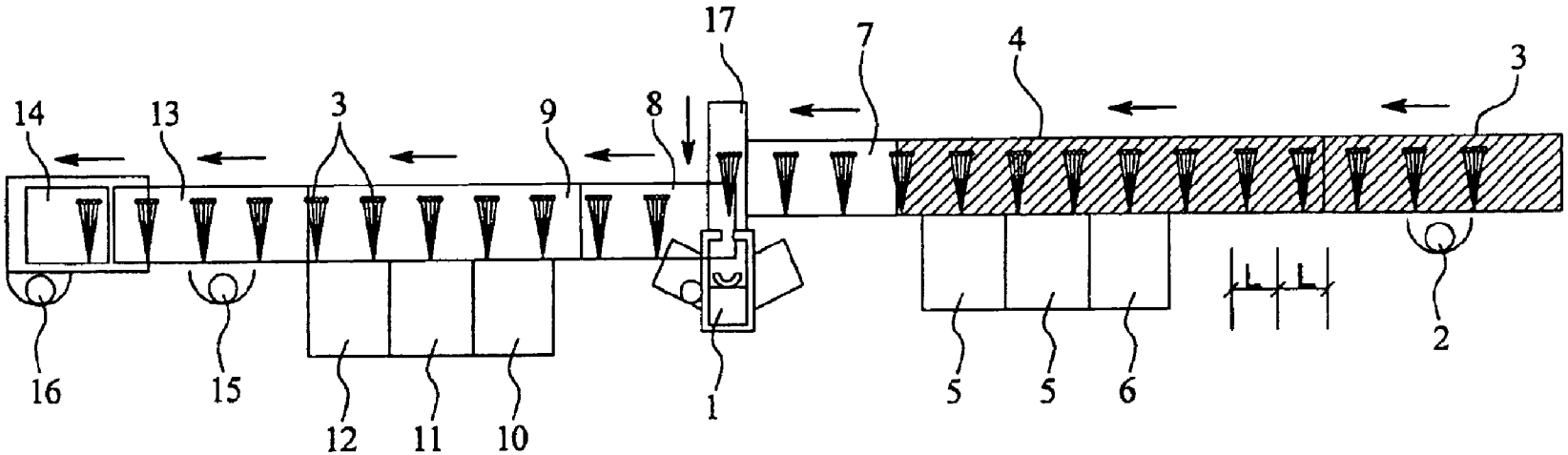
FIG. 1 shows a schematic top view of the packing procedure with the apparatus according to the invention for executing the specific work method for packing large amounts of flower bouquets.

FIG. 1 shows in a schematic way the whole procedure for packing large amounts of flower bouquets with the special apparatus 1 according to the invention. The procedure begins with laying down flower bouquets 3 transversely on the conveyor belt or bouquet line 4 by person 2, and this with a suitable interval specified by not indicated carriers on the bouquet line. The width of the mentioned conveyor belt is approximately 800 mm, in view of the flower bouquets.

Figure 2:
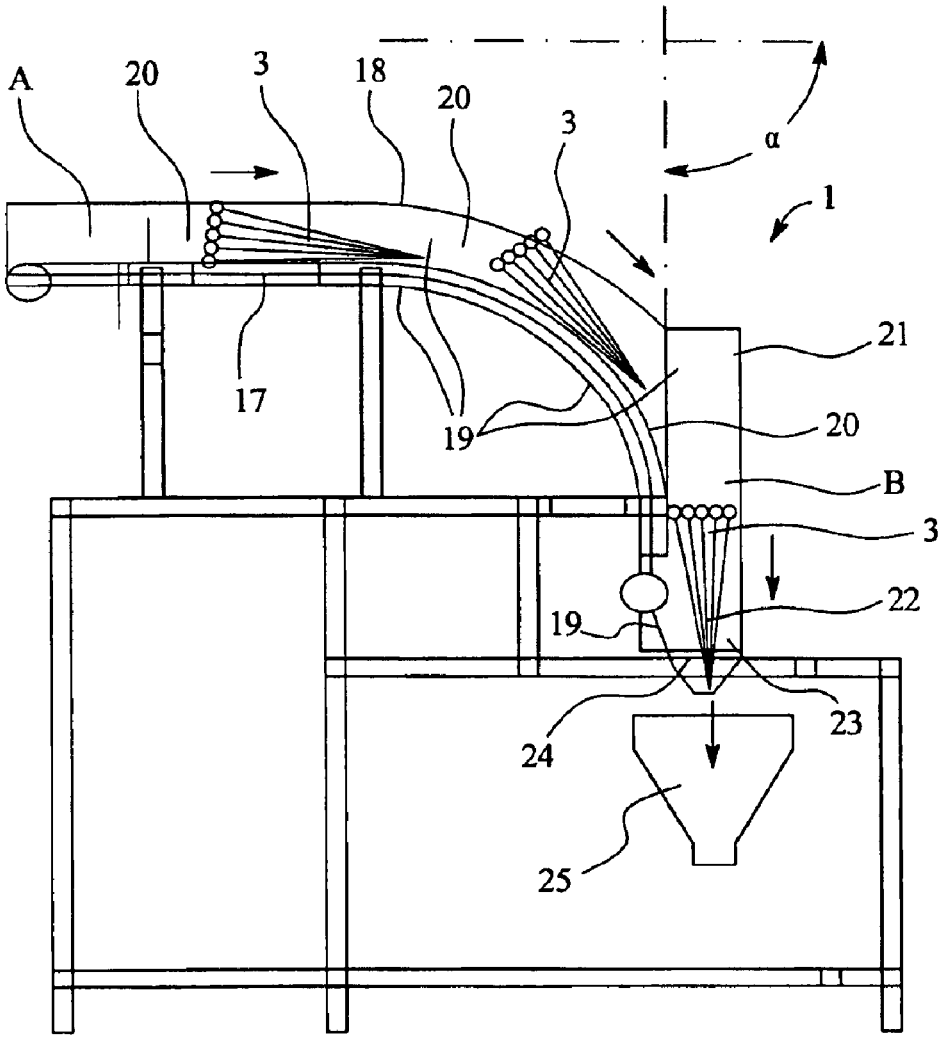
FIG. 2 shows a schematic side view of the apparatus for packing flower bouquets.

On this conveyor belt 4 the flower bouquets undergo more processes, such as the binding and cutting of the stems etc. at the sections 5 and 6. After that the flower bouquets go onto a lifting conveyor belt 7 to the actual packing machine or apparatus 1 according to the invention, of which the working is shown in FIG. 2. After that discharging 8 of the packed flower bouquets is done and on the bouquet line 9 some more processes are done such as applying "Chrysal" at 10, taping at 11 and applying a sticker at 12. All packed or covered flower bouquets 3 are put onto a collecting conveyor 13 and can be packed into boxes by persons 15 and 16.

FIG. 2 shows a schematic side view of the actual apparatus 1 according to the invention.

From the lifting conveyor belt 7 (see FIG. 1) the flower bouquets 3 fall on the feeding conveyor belt 17 which turns from the horizontal position A into a vertical position B, i.e. rotating at an angle $\alpha$ of approximately 90 degrees. The feeding conveyor belt 17 is approximately 20 cm wide and is supplied with raised plates or lateral partitions 18 at the sides to avoid falling off sideways of the flower bouquets 3. To create compartments 20, cross partitions 19 have also been applied. The flower bouquets 3 fall onto the feeding belt 17 accordingly into the compartments 20 and are thus rotated from the horizontal position into the vertical position and then a box shaped cell space 22 is created by the vertical plate 21. Subsequently, by turning away the cross partition 19 the flower bouquet 3 with its stems falls onto the trap door instrument 24, which is in closed position and then opens (see FIGS. 3A and 3B) and the flower bouquet falls in the already opened cover 25 and the whole is finished according to the process described in FIG. 1.

Figure 3B:
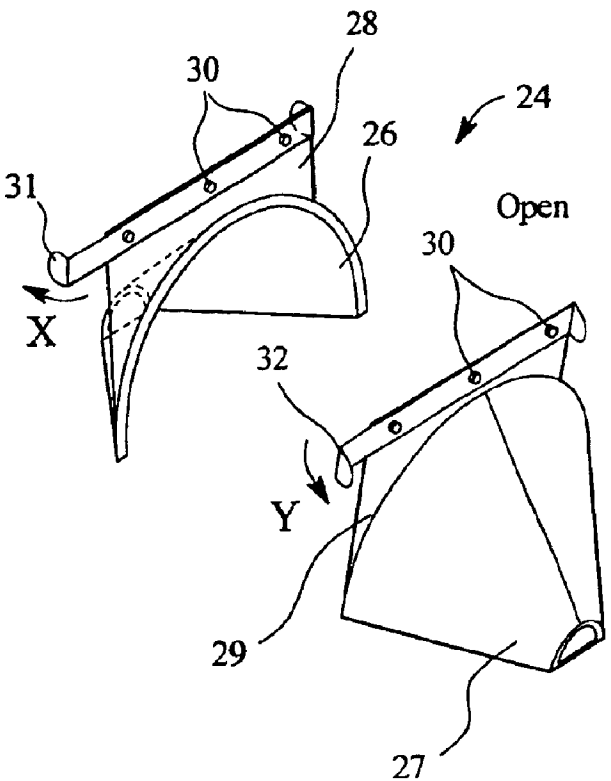
FIGS. 3A and 3B show schematically in oblique projection the trap door instrument in closed (FIG. 3A) and in opened position (FIG. 3B).
Figure 3A:
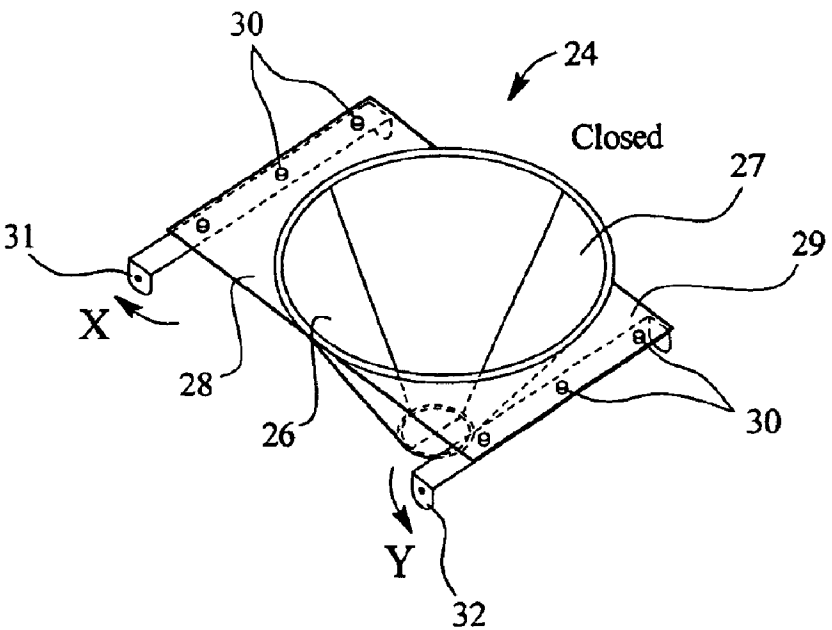

FIGS. 3A and 3B show schematically in oblique projection the trap door instrument 24 in closed (FIG. 3A) and opened position (FIG. 3B). The trap door instrument 24 consists of two conical halves 26 and 27, which are welded in the plate parts 28 and 29. The plate parts 28 and 29 are fastened by means of screws 30 on the rotating shafts 31 and 32. The shafts 31 and 32 can rotate in the directions X and Y through which the trap door instrument 24 opens and goes from the position in FIG. 3A to the position in FIG. 3B. By the apparatus 1 with the matching work method according to the invention a very efficient packing machine for flower bouquets 3 is created.

Finally it has to be emphasized, that the above description constitutes a preferred embodiment of the present invention and that further variations and modifications are still possible without departing the scope of this patent description.

What is claimed is:

1. A method for packing flower bouquets comprising the steps of:

feeding a plurality of flower bouquets transversely in a first direction via a first conveyor to a second conveyor, wherein the plurality of flower bouquets are conveyed in an approximately horizontal orientation and are separated by a horizontal distance;

lifting the plurality of flower bouquets via the second conveyor to a third conveyor placed at a right angle to the first conveyor;

rotating the plurality of flower bouquets through an angle of rotation from an approximately horizontal position to an approximately vertical position via the third conveyor, wherein the third conveyor includes compartments forming approximately box shaped cell spaces;

dropping the plurality of flower bouquets, stems first, from the third conveyor onto a trap door instrument;

wrapping the plurality of flower bouquets;

dropping the wrapped plurality of flower bouquets from the trap door instrument onto a fourth conveyor, and transporting the wrapped flower bouquets via the fourth conveyor to collection boxes for packaging and shipment of the wrapped plurality of flower bouquets.

2. The method of claim 1 wherein the width of the first conveyor and the second conveyor is approximately 700 mm and the horizontal distance between the flower bouquets is approximately 500 mm.

3. The method of claim 1 wherein the angle of rotation is approximately 90 degrees.

4. The method of claim 1 wherein the trap door instrument is fed by an automated feeding machine adapted to the packing process.

5. The method of claim 1 wherein wrapping the plurality of flower bouquets further comprises wrapping the packed stems of the flower bouquet using an automated taping machine.

6. An apparatus for packing flower bouquets comprising:

a first conveyor, wherein said first conveyor is oriented approximately horizontally;

a second conveyor adjacent to said first conveyor, wherein said second conveyor includes a first end and a second end, further wherein said second end is elevated with respect to said first end;

a third conveyor adjacent to said second conveyor and oriented at a right angle relative to said second conveyor, wherein said third conveyor includes lateral and cross partitions, wherein said cross partitions are spaced a distance, and said lateral and cross partitions are provided at a height, to form compartments into which flower bouquet may be dropped, further wherein said third conveyor includes a first conveyor portion that is approximately horizontal and a second conveyor portion that is approximately vertical, wherein said second conveyor portion runs along a vertical plate to create a box-shaped cell space; and a trap door instrument adjacent to said second conveyor portion of said third conveyor; and a fourth conveyor adjacent to said trap door instrument.

7. The apparatus of claim 6 wherein the height of the lateral and cross partitions is approximately 100 mm and the distance between cross partitions is approximately 700 mm.

8. The apparatus of claim 6 wherein said first conveyor and said second conveyor are approximately 800 mm wide and said third conveyor is approximately 200 mm wide.

9. The apparatus of claim 6 wherein said trap door instrument includes two conical constructed halves and a cover, which open simultaneously so flower bouquets fall stems first through said trap door instrument.

10. The apparatus of claim 6 wherein said trap door instrument further comprises an automated feeding machine and an automated taping machine.

* * * * *